US005277420A

United States Patent [19]

Greive

[11] Patent Number: 5,277,420

[45] Date of Patent: Jan. 11, 1994

[54] BALL BEARING IN A CONVEYOR DEVICE FOR PAPER SHEETS

[75] Inventor: Martin Greive, Heidelberg, Fed. Rep. of Germany

[73] Assignee: Heidelberger Druckmaschinen AG, Heidelberg, Fed. Rep. of Germany

[21] Appl. No.: 877,861

[22] Filed: May 4, 1992

[30] Foreign Application Priority Data

May 3, 1991 [DE] Fed. Rep. of Germany ..... 4114478

[51] Int. Cl.[5] ..... B65H 5/02

[52] U.S. Cl. ..... 271/273; 271/277; 226/181

[58] Field of Search ..... 271/272, 273, 277; 226/181; 198/624, 836.2

[56] References Cited

U.S. PATENT DOCUMENTS 3,630,518 12/1971 Street ..... 271/272 X
3,663,013 5/1972 Wickers ..... 271/272 X
3,951,402 4/1976 Skinner ..... 271/273

FOREIGN PATENT DOCUMENTS 496215 4/1930 Fed. Rep. of Germany .
541477 12/1931 Fed. Rep. of Germany .
964600 5/1957 Fed. Rep. of Germany .
2758456 7/1979 Fed. Rep. of Germany ..... 271/273

OTHER PUBLICATIONS

C. H. Souba, Document Feeding Device, 12-71, p. 2181, IBM Technical Disclosure vol. 14 No. 7.

*Primary Examiner*—H. Grant Skaggs
*Assistant Examiner*—Carol Lynn Druzbick
*Attorney, Agent, or Firm*—Herbert L. Lerner; Laurence A. Greenberg

[57] ABSTRACT

A ball bearing in a conveyor device for sheets includes ball guide bodies having ball guide openings formed therein. Balls are to be disposed in the openings. The ball guide bodies have lateral contact slits formed therein through which the balls can be removed and replaced through the ball guide openings by contact with the balls from the outside.

5 Claims, 3 Drawing Sheets

BALL BEARING IN A CONVEYOR DEVICE FOR PAPER SHEETS

The invention relates to a ball bearing in a conveyor device for paper sheets.

A conveyor device for paper sheets is known from German Patent DE-PS 541,477, in which a ball bearing is additionally provided to establish an entraining contact between the sheet and conveying means being used.

The balls are each guided in a bearing position thereof by a ball retainer. In order to enable replacement of the balls for adaptation to operating conditions, a separate ball cage is provided for each ball, it is inserted along with the ball in a retaining opening provided for it in the ball retainer and it is removed from it along with the ball. The use of such changing cages entails undesirable additional manufacturing expense and additional labor for changing balls. When the cages are inserted, irregularities in the correct insert position of the cages and therefore of the balls can easily occur, which renders the bearing function of the ball bearings questionable.

Ball bearings in a conveyor device for paper sheets in which the balls can be removed or replaced through openings in their ball guide bodies, with the aid of special suction tools that are passed through the openings, are also known. However, a requirement in such a structure is that each time a ball is to be removed, the appropriate special tools must be ready at hand. Looking for the tools and picking them up can be problematic and wastes time.

It is accordingly an object of the invention to provide a ball bearing in a conveyor device for paper sheets, which overcomes the hereinafore-mentioned disadvantages of the heretofore-known devices of this general type.

With the foregoing and other objects in view there is provided, in accordance with the invention, a ball bearing in a conveyor device for paper sheets, comprising ball guide bodies having ball guide openings formed therein, balls to be disposed in the openings, and the ball guide bodies having lateral contact or access slits formed therein through which the balls can be removed and replaced through the ball guide openings by contact with the balls from the outside.

In this kind of ball bearing, the balls can be reliably pushed out of the ball guide body from outside, through the opening in the ball guide body that is intended for that purpose. No special tool is needed. Depending on the slit width selected, even a cotton swab or some other suitably thin contact or access tool can be used. The balls can be replaced quickly and simply. Such an apparatus is also favorable in terms of manufacture.

In accordance with another feature of the invention, each of the ball guide bodies is disposed transversely relative a main sheet conveying direction and is disposed across and past a sheet conveying plane, and each of the ball guide bodies has a plurality of the ball guide openings formed therein. Such an embodiment of a conveyor device for paper sheets with a ball bearing is especially simple and advantageous from the standpoint of construction and manufacture.

The following two embodiments enable especially advantageous structures of the ball bearing to be provided from the standpoint of manufacture, function, and the insertion of a ball bearing, and from the standpoint of the effort for replacing the balls.

In accordance with a further feature of the invention, the ball guide openings in the ball guide bodies are cylindrical through bores for ball guidance being perpendicular to the sheet conveying plane, from which the balls can be removed and replaced upwardly, the contact slits are parallel to the through bores and extend to the outside counter to the main sheet conveying direction from the through bores outwardly through the guide bodies, and the contact slits have a width being approximately as thick as a finger. In such a ball bearing, easy replacement of the balls can be performed simply by reaching in with a fingertip, without any other tool.

In accordance with an added feature of the invention, the ball guide openings in the ball guide bodies are cylindrical through bores for ball guidance being perpendicular to the sheet conveying plane, from which the balls can be removed and replaced upwardly, the contact slits are parallel to the through bores and extend to the outside counter to the main sheet conveying direction from the through bores outwardly through the guide bodies, and the balls have a spherical surface extending to the outside through the contact s its. In such a ball bearing, the spherical surface that passes through the slit can be removed through the opening simply by entraining, using a body surface that sweeps the guide body along the slit. The "body surface" may be simply the surface of a hand or fingertip of the machine operator.

In accordance with a concomitant feature of the invention, the ball guide openings in the ball guide bodies are cylindrical through bores for ball guidance being perpendicular to a sheet conveying plane, from which the balls can be removed and replaced upwardly, the contact slits are parallel to the through bores and extend to the outside counter to a main sheet conveying direction from the through bores outwardly through the guide bodies, and the balls have a spherical surface extending to the outside through the contact slits. These characteristics make for an embodiment of ball bearings in conveyor devices that is especially easy to manufacture, particularly in conveyor devices in which either the inserted conveying means are lowered or the ball guide bodies are raised during operation.

Other features which are considered as characteristic for the invention are set forth in the appended claims.

Although the invention is illustrated and described herein as embodied in a ball bearing in a conveyor device for paper sheets, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 1:
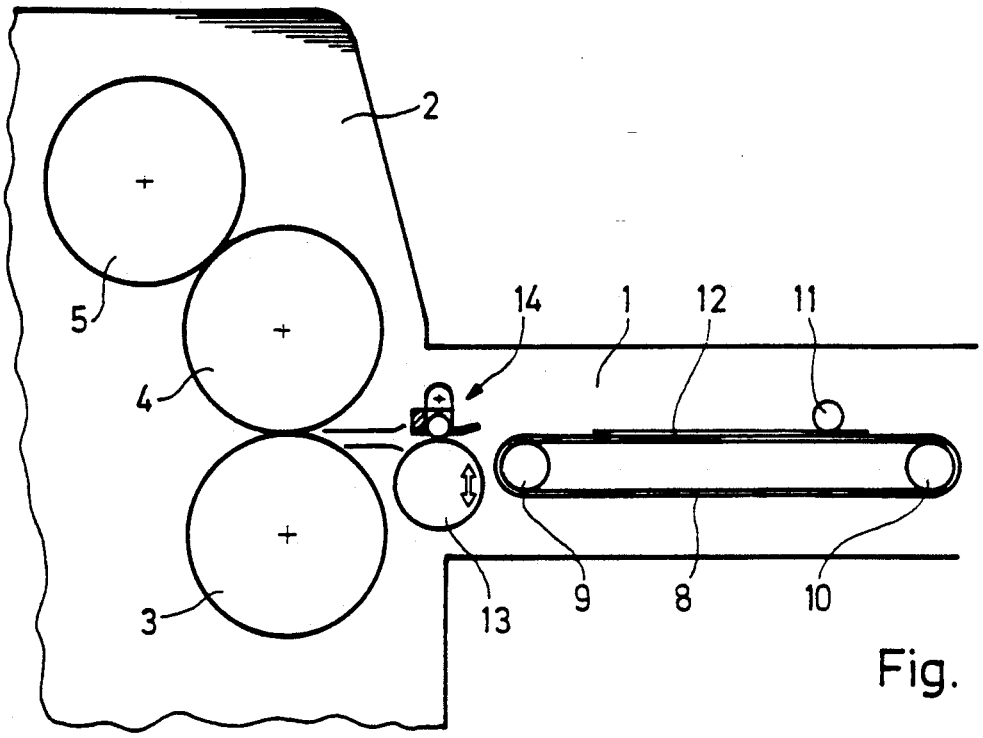
FIG. 1 is a fragmentary, diagrammatic, side-elevational view of a sheet feeder with a device according to the invention.
Figure 2:
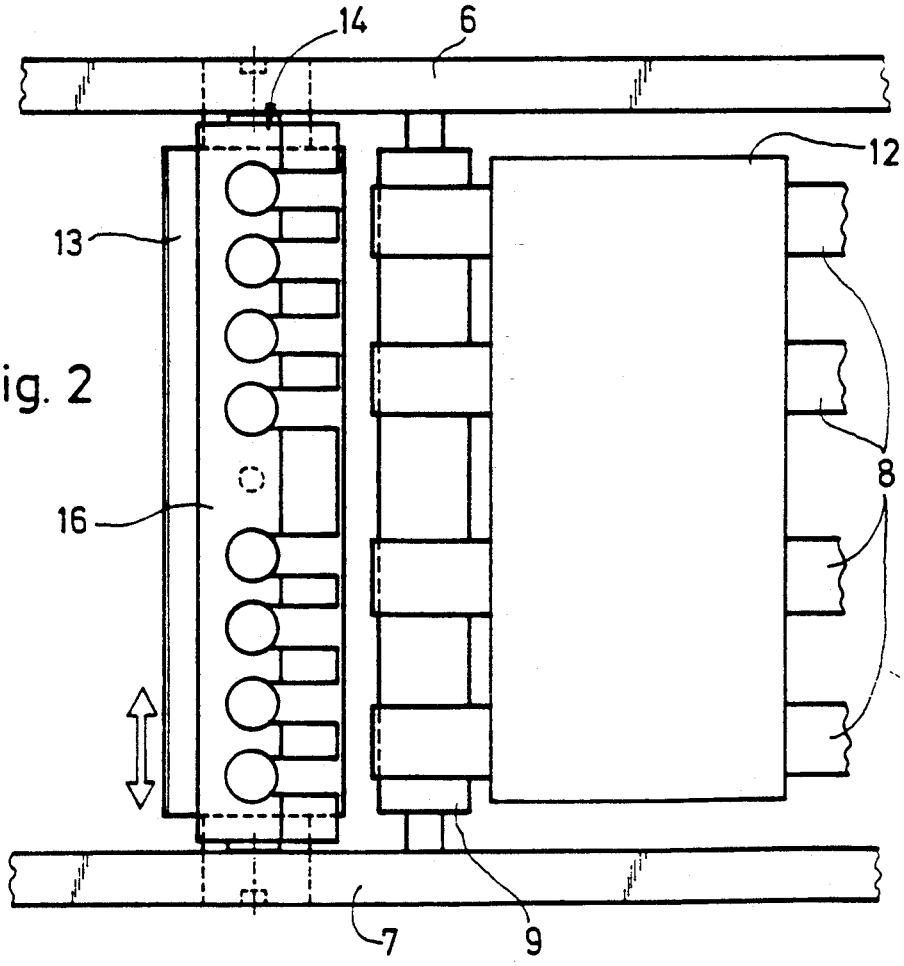
FIG. 2 is an enlarged, fragmentary, top-plan view of FIG. 1.

Referring now in detail to the figures of the drawing, in which advantageous embodiments of the invention are shown by way of example in a feed region of a sheet-type offset rotary printing press and first, particularly, to FIGS. 1 and 2 thereof, there is seen a part of a sheet-fed offset rotary printing press, in which a paper sheet 12 is conveyed over a feed table 1 to a printing unit 2 with an impression cylinder 3, a rubber blanket cylinder 4, and a plate cylinder 5.

In order to supply the paper sheets 12 which are delivered from a non-illustrated feed stack, conveyor belts 8 revolving around deflection rollers 9, 10 and a conveyor roller 13 following the conveyor belts in a conveyor device, are disposed on the feed table 1. The deflection rollers 9, 10 and the conveyor rollers 13 are disposed in side walls 6, 7 of the feed table 1. In order to increase the effective frictional forces between the sheets 12 and the conveyor belts 8 or the conveyor roller 13 to a value required for securely entraining the sheets 12, which value in turn depends on the applicable operating requirements, ball bearings 11 and 14 are provided both above the conveyor belts 8 and above the conveyor rollers 13.

Figure 3:
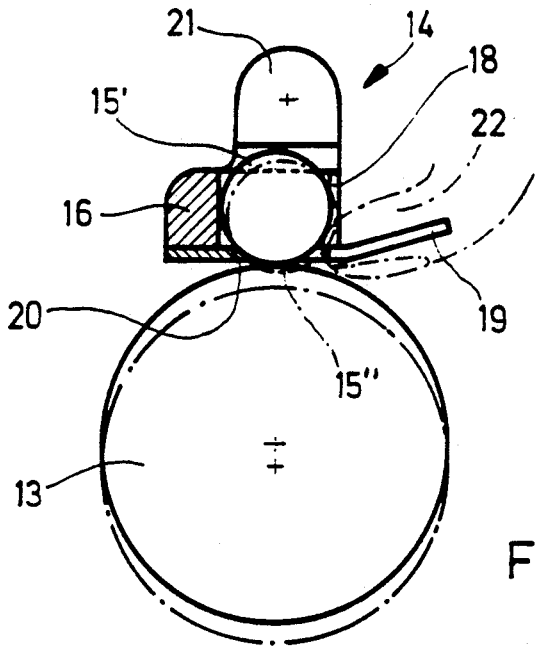
FIG. 3 is a side-elevational view of a first embodiment of a conveyor device according to the invention.

The ball bearing 14 includes a ball guide body in the form of at least one crossbar 16 which is disposed crosswise relative to the sheet conveying direction across the sheet feed table 1. The crossbar 16 is secured to the side walls or parts 6, 7, such as with retainer attachments 21 disposed on both of its outer region pointing toward the side parts 6, 7, as seen in FIG. 3.

The crossbar 16 is provided with ball guide openings in the form of through bores 17 for ball guidance, which are aligned perpendicularly to the sheet conveying plane, are located linearly side by side transversely to the sheet conveying direction across the sheet feed table 1, and are distributed symmetrically relative to the middle of the sheet table.

A restraining baffle 19 is secured to the lower surface of the crossbar 16. The restraining baffle 19 is provided with circular penetration openings 20 that are disposed concentrically with the ball guiding through bores 17. The penetration openings 20 have a diameter that is less than the diameter of balls 15 that are used, but is large enough to ensure that the balls 15, which have a spherical surface, pass sufficiently far through the applicable penetration opening 20 to press down on the sheets 12 to be conveyed due to their own weight.

Starting from the middle of each through bore 17 provided for ball guidance, the crossbar 16 and the restraining baffle 19 are congruently slit open to the outside in the direction opposite to the sheet conveying direction, parallel to the through bore 17 and the penetration opening 20, to form respective contact, engagement or access slits 18, 23.

The diameter of the through bores 17 for ball guidance is dimensioned in such a way that the balls 15 which are inserted are guided in them with play.

A ball bearing that is constructed in this way may also be inserted into sheet conveyor devices in which operating requirements make it desirable to have cyclical sheet entraining intervals provided by means of cyclical changes in spacing between the crossbar 16 and the conveyor roller 13.

As is shown in FIG. 1 by way of an example with the aid of an arrow, the conveyor roller 13 may be equipped to be pivotable up and down cyclically for this purpose, through the use of control means, which are not shown in further detail, such as a cam-controlled lever mechanism. The restraining baffle 19 keeps balls 15" back, in the pivoted-away position of the conveyor roller 13. With the conveyor roller 13 pivoted upward, balls 15' rest on the conveyor rollers 13 or during sheet conveyance, upon the sheet 12 to be conveyed, due to their own weight.

It is also conceivable to equip the crossbar 16 with a lifting mechanism.

By way of example, the conveyor roller 13 may also be equipped with a lateral displacement mechanism, that is not shown in further detail but is suggested in FIG. 2 by an arrow representing the direction of displacement of the conveyor roller 13. An example of such a mechanism is an axial cam-controlled lever mechanism, for laterally entraining the sheet, for instance to straighten it laterally.

Figure 4:
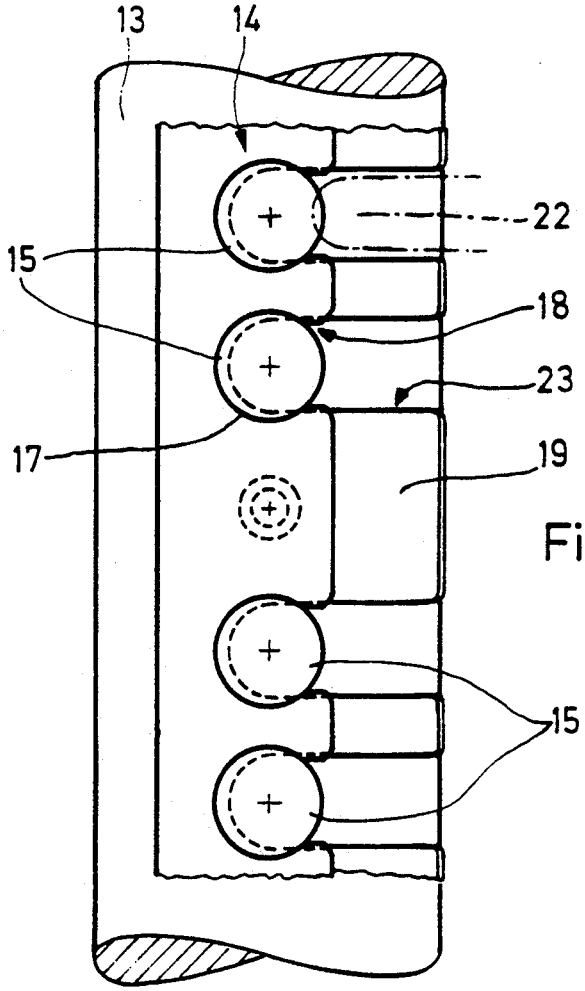
FIG. 4 is a fragmentary, top-plan view of FIG. 3.

As is shown in FIGS. 3 and 4, the balls 15 may be simply pushed upward out of the ball guiding through bore 17 by using the tip of a finger 22 that passes through a slit 18 in the crossbar 16, below the center point of the ball 15. The slit 18 is not quite as thick as a finger.

A lighter-weight ball 15, which is for lighter, thinner paper sheets 12 to be conveyed, can then be subsequently allowed to simply drop into the through bore 17 for ball guidance.

Figure 5:
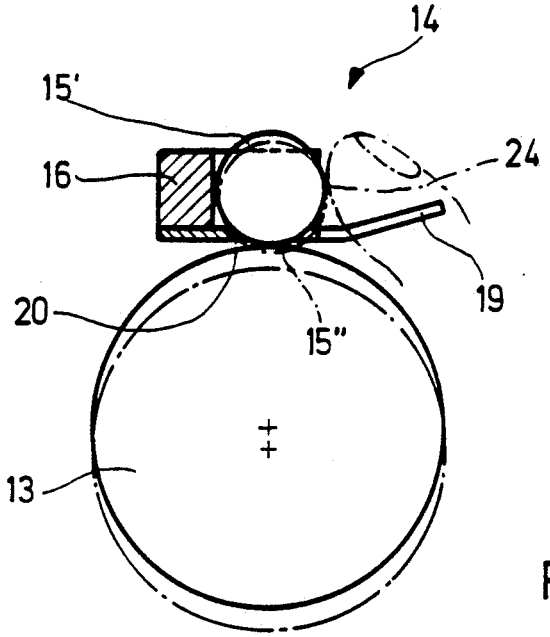
FIG. 5 is a view similar to FIG. 3 of a second embodiment of a conveyor device.
Figure 6:
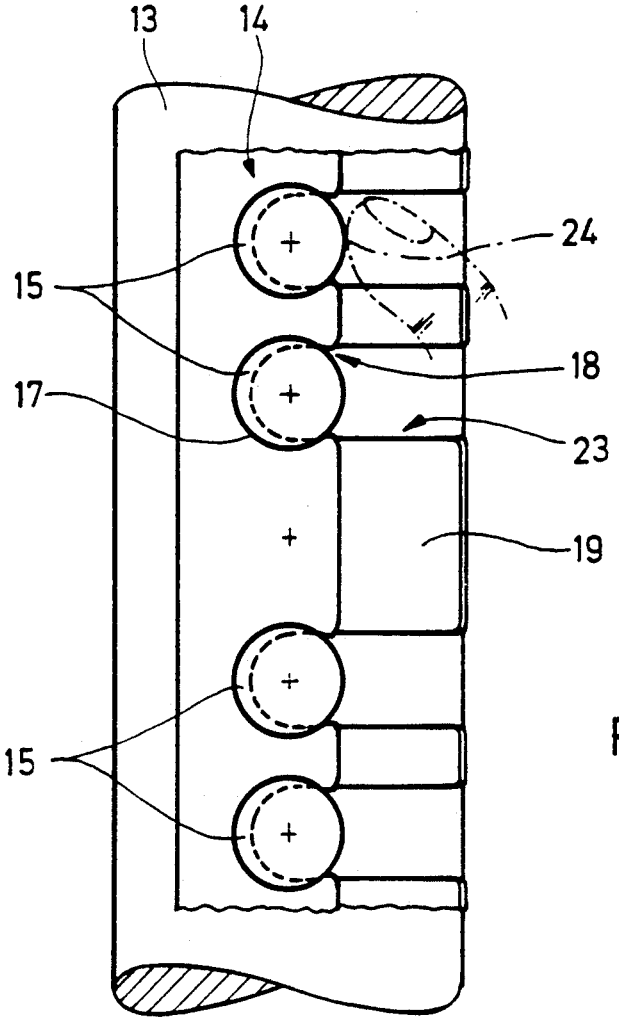
FIG. 6 is a view similar to FIG. 4 of a top-plan view of FIG. 5.

As is shown in FIGS. 5 and 6, it is especially advantageous to position the through bores 17 for ball guidance in the crossbar 16 in such a way that the balls 15 which are inserted extend somewhat outward through the slit 18 through the crossbar with a spherical surface, so that the balls can be pushed upward and replaced in the simplest manner by using finger surfaces 24 extending outward along the slit 18 in the crossbar.

The ball bearing 11 can likewise be equipped in one of the above-described embodiments.

I claim:

1. A ball bearing in a conveyor device for sheets, comprising:

a ball guide body having a plurality of ball guide openings formed therein, balls to be disposed in said openings, said ball guide body having lateral contact slits formed therein through which said balls can be removed and replaced through said ball guide openings by contact with said balls from outside said ball guide body, and said ball guide body having a longitudinal axis extending transversely relative to a main sheet conveying direction and extending substantially across a sheet conveying plane.

2. The ball bearing in a conveyor device for sheets according to claim 1, wherein said ball guide openings in said ball guide body are cylindrical through bores for ball guidance being perpendicular to the sheet conveying plane, from which said balls can be removed and replaced upwardly, said contact slits are parallel to said through bores and extend to an outside of said ball guide body counter to the main sheet conveying direction from said through bores outwardly through said guide body, and said contact slits have a width defining means for allowing manual access to said balls.

3. The ball bearing in a conveyor device for sheets according to claim 2, wherein said ball guide body has a lower surface, and including restraining baffles disposed at said lower surface of said ball guide body, said restraining baffles having penetration openings formed therein for said balls, each of said penetration openings being disposed at respective one of said through bores provided for ball guidance, said penetration openings having smaller diameters than said balls inserted into a respective one of said through bores, and said restraining baffles having contact slits formed therein congruently with said contact slits in said ball guide body.

4. The ball bearing in a conveyor device for sheets according to claim 1, wherein said ball guide openings in said ball guide body are cylindrical through bores for ball guidance being perpendicular to a sheet conveying plane, from which said balls can be removed upwardly, said contact slits are parallel to said through bores and extend to an outside of said ball guide body counter to the main sheet conveying direction from said through bores outwardly through said guide body, and said balls have a spherical surface partially protruding from said contact slits to the outside.

5. The ball bearing in a conveyor device for sheets according to claim 4, wherein said ball guide body has a lower surface, and including restraining baffles disposed at said lower surface of said ball guide body, said restraining baffles having penetration openings formed therein for said balls, each of said penetration openings being disposed at respective one of said through bores provided for ball guidance, said penetration openings having smaller diameters than said balls inserted into a respective one of said through bores, and said restraining baffles having contact slits formed therein congruently with said contact slits in said ball guide body.

* * * * *